US009620322B2

(12) United States Patent
Burge

(10) Patent No.: US 9,620,322 B2
(45) Date of Patent: Apr. 11, 2017

(54) ARC SUPPRESSOR FOR FUSIBLE ELEMENTS

(71) Applicant: Mersen USA Newburyport-MA, LLC, Newburyport, MA (US)

(72) Inventor: Robert M. Burge, Plaistow, NH (US)

(73) Assignee: Mersen USA Newburyport-MA, LLC, Newburyport, MA (US)

( * ) Notice: Subject to any disclaimer, the term of this patent is extended or adjusted under 35 U.S.C. 154(b) by 285 days.

(21) Appl. No.: 14/251,701

(22) Filed: Apr. 14, 2014

(65) Prior Publication Data

US 2015/0294828 A1 Oct. 15, 2015

(51) Int. Cl.
*H01H 85/38* (2006.01)
*H01H 85/22* (2006.01)

(52) U.S. Cl.
CPC ..... *H01H 85/38* (2013.01); *H01H 85/22* (2013.01); *H01H 2085/383* (2013.01); *H01H 2085/388* (2013.01)

(58) Field of Classification Search
CPC .. H01H 85/22; H01H 85/38; H01H 2085/381; H01H 2085/383; H01H 2085/388
USPC ..... 337/234–237, 260, 273–282
See application file for complete search history.

(56) References Cited

U.S. PATENT DOCUMENTS 2,892,061 A * 6/1959 Kozacka ..... H01H 85/38 337/158
2,964,604 A * 12/1960 Jacobs, Jr. ..... H01H 85/42 337/159
3,020,372 A * 2/1962 Kozacka ..... H01H 85/0456 337/112
3,275,771 A * 9/1966 Salzer ..... H01H 85/42 337/159
3,601,737 A 8/1971 Baird et al. ..... 337/159
4,625,195 A * 11/1986 Robbins ..... H01H 85/42 337/159
5,245,308 A 9/1993 Herbias ..... 337/273
5,359,174 A 10/1994 Smith et al. ..... 200/144
5,406,245 A 4/1995 Smith et al. ..... 337/273
5,596,306 A 1/1997 Kowalik et al. ..... 337/282
6,160,471 A 12/2000 Rybka et al. ..... 337/278
(Continued)

OTHER PUBLICATIONS

International Search Report and Opinion from corresponding PCT/US15/18842 (Form PCT/ISA/220) dated Jun. 22, 2015.

*Primary Examiner* — Anatoly Vortman
*Assistant Examiner* — Jacob Crum
(74) *Attorney, Agent, or Firm* — Kusner & Jaffe

(57) ABSTRACT

An arc suppressor fixable to a fusible element to suppress electrical arcs and prevent the spread of electric arc "burn-back." The arc suppressor includes first and second inner members comprised of pre-cured silicone rubber, and first and second outer members comprised of an arc suppressing material (e.g., melamine). The inner and outer members form a sandwich around a portion of the fusible element, wherein the first inner member is located adjacent to a first surface of the fusible element and the second inner member is located adjacent to an opposing second surface of the fusible element. The first outer member is located adjacent to the first inner member and the second outer member is located adjacent to the second inner member. Mechanical fasteners tightly engage together the first and second inner members, the fusible element, and the first and second outer members.

21 Claims, 3 Drawing Sheets

(56) References Cited

U.S. PATENT DOCUMENTS

| | | | | |
|---|---|---|---|---|
| 6,903,649 | B2 | 6/2005 | Ackermann | 337/296 |
| 7,659,804 | B2 | 2/2010 | Harris et al. | 337/159 |
| 2004/0081782 | A1 | 4/2004 | Stavnes et al. | 428/36.3 |
| 2007/0075822 | A1 | 4/2007 | Pachla et al. | 337/297 |
| 2008/0122571 | A1 | 5/2008 | Buchanan et al. | 337/276 |
| 2009/0027155 | A1 | 1/2009 | Arikawa et al. | 337/228 |

* cited by examiner

ARC SUPPRESSOR FOR FUSIBLE ELEMENTS

FIELD OF THE INVENTION

The present invention relates generally to the field of arc suppression, and more particularly to an arc suppressor for use with a fusible element.

BACKGROUND OF THE INVENTION

It is well known to use fuses in electrical circuits to interrupt the flow of current when there is an overcurrent (i.e., overload current or short circuit) or overload event. Fuses typically include one or more fusible elements (also known as "fusible links") electrically connected to two end conductors or terminals located at opposite ends of the fuse.

Under normal operation, when the fuse is operating at or near its amp rating, it functions as a conductor. However, if a short circuit or overload condition occurs and persists for more than a short interval of time, the temperature of the fusible element eventually reaches a level that causes a high resistance segment of the fusible element to melt. As a result, a gap is formed and an electric arc established. However, as the arc causes the fusible element to "burn back," the gap becomes progressively larger. Electrical resistance of the arc eventually reaches such a high level that the arc cannot be sustained and is extinguished. The fuse will have then completely cut off all current flow in the circuit. If arc suppression is inadequate, under some fault current conditions, a fuse may not safely clear an overcurrent or overload event, thereby resulting in damage to circuit components.

One material with arc suppressing characteristics is silicone rubber. Silicone rubber is an elastomer composed of silicone containing silicon together with carbon, hydrogen, and oxygen. Silicone rubber is generally non-reactive, stable, and resistant to extreme environments and temperatures from −55° C. to +300° C. while still maintaining its useful properties. One common type of silicone rubber for use in arc suppression applications is room temperature vulcanizing (RTV) silicone.

Silicone arc suppressors have been formed by applying a free flowing (at room temperature) silicone rubber sealant to a fusible element. This free flowing silicone rubber sealant is then air cured to increase its viscosity such that it hardens into a solid-like state and conforms to the shape of the fusible element.

One disadvantage to such silicone rubber arc suppressors is that there can be inconsistency in the silicone rubber sealant. In this regard, due to ambient air conditions (e.g., humidity), the cure time of a free flowing silicone rubber sealant is increased, potentially causing the silicone rubber to not fully cure. As a result, the silicone rubber arc suppressor may not function as intended during operation of the fuse, thereby causing unpredictable results during an overcurrent or overload event.

Another disadvantage of existing silicone rubber arc suppressors is that cure time for the silicone rubber slows the speed at which a fuse can be manufactured, thereby increasing production costs.

The present invention provides an arc suppressor that overcomes these and other problems associated with existing silicone rubber arc suppressors.

SUMMARY OF THE INVENTION

In accordance with the present invention, there is provided a fuse comprising: (1) a fusible element made of a conductive metal having opposing first and second surfaces, said fusible element including (a) an intermediate portion having at least one region of high resistance, and (b) first and second end portions located at opposite sides of the intermediate portion; and (2) at least one arc suppressor fixed to the fusible element. Each arc suppressor comprises: (i) first and second inner members comprised of pre-cured silicone rubber; (ii) first and second outer members comprised of an arc quenching material, wherein said first inner member is located adjacent to the first surface of the fusible element and the second inner member is located adjacent to the second surface of the fusible element, and said first outer member is located adjacent to the first inner member and the second outer member is located adjacent to the second inner member; and (iii) one or more fasteners for fixing the first and second inner members and the first and second outer members to the fusible element.

In accordance with another aspect of the present invention, there is provided an arc suppressor fixable to a fusible element, the arc suppressor comprising: (i) first and second inner members comprised of pre-cured silicone rubber; (ii) first and second outer members comprised of an arc quenching material, wherein said first inner member is located adjacent to a first surface of the fusible element and the second inner member is located adjacent to an opposing second surface of the fusible element, and said first outer member is located adjacent to the first inner member and the second outer member is located adjacent to the second inner member; and (iii) one or more fasteners for fixing the first and second inner members and first and second outer members to the fusible element.

An advantage of the present invention is the provision of an arc suppressor that can be manufactured more quickly than existing arc suppressors, thereby increasing production throughput.

Another advantage of the present invention is the provision of an arc suppressor that uses mechanical fastening means to fix the arc suppressor to a fusible element.

Yet another advantage of the present invention is the provision of an arc suppressor that can be applied to a wide variety of DC and AC applications where excessive electric arc "burn-back" is experienced.

These and other advantages will become apparent from the following description of illustrated embodiments taken together with the accompanying drawings and the appended claims

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
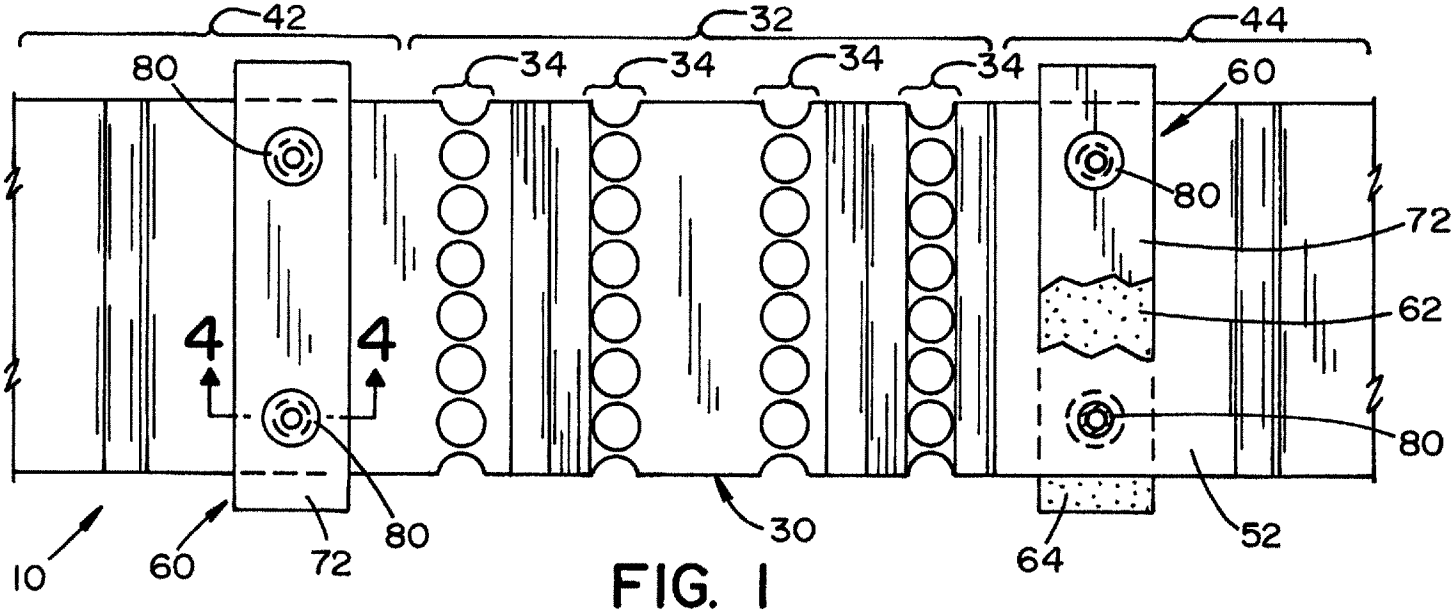
FIG. 1 is a top plan view of a fuse including a fusible element and a plurality of arc suppressors according to an embodiment of the present invention.
Figure 2:
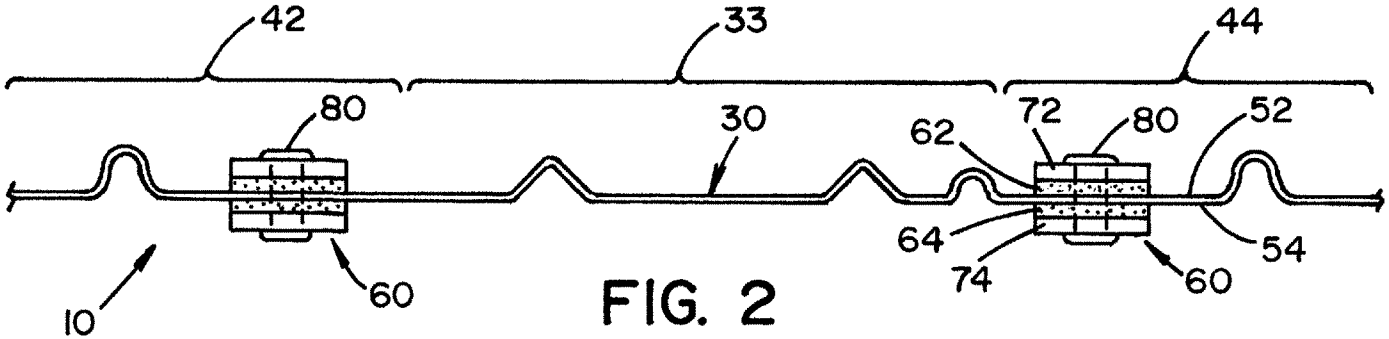
FIG. 2 is a side plan view of the fuse shown in FIG. 1.

Referring now to the drawings wherein the showings are for the purposes of illustrating an embodiment of the invention only and not for the purposes of limiting same, FIGS. 1 and 2 show a fuse 10 comprised of a fusible element 30 and a pair of arc suppressors 60, according to an embodiment of the present invention.

Fusible element 30 is made of a conductive metal having opposing first and second surfaces 52, 54. The conductive metal may include, but is not limited to, silver, gold, copper, aluminum, and the like. Fusible element 30 is comprised of an intermediate portion 32, having at least one high resistance region 34, and lateral first and second end portions 42, 44 located at opposite sides of intermediate portion 32.

High resistance regions 34 provide intermediate portion 32 with a higher resistance than first and second end portions 42, 44. Each high resistance region 34 has a reduced cross-sectional area that can be created by use of, for example, notches, perforations, and the like. In the illustrated embodiment, circular openings (i.e., punch holes) form perforations in intermediate portion 32. As a result of the reduced cross-section area, there is a significant likelihood of fuse 10 "blowing" in intermediate portion 32. This is desirable, since any arc formed in intermediate portion 32 must then travel the longest possible distance before reaching the distal ends of fusible element 30.

Figure 3:
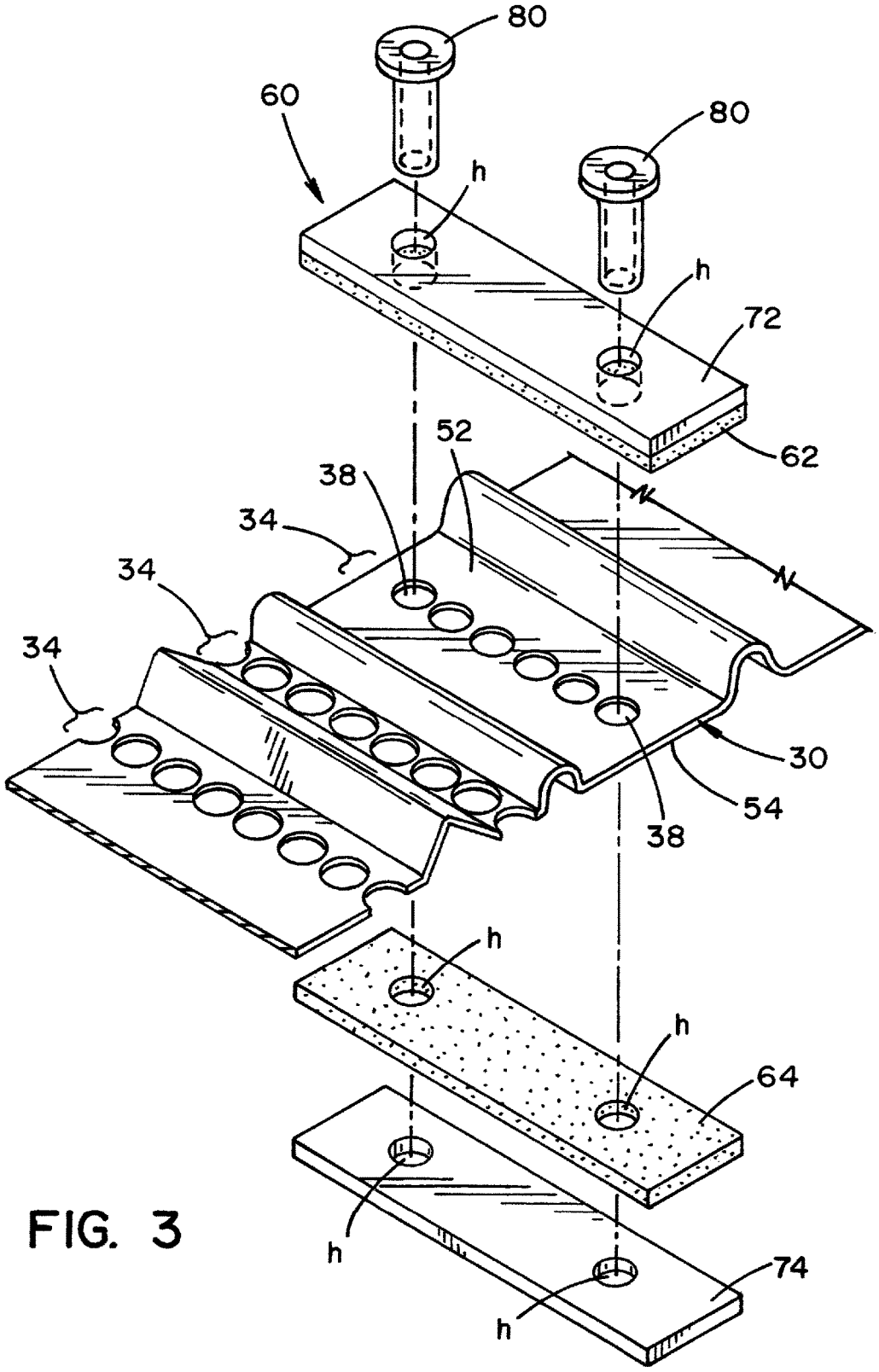
FIG. 3 is an exploded view of the arc suppressor, according to the present invention, and a portion of the fusible element.

First and second end portions 42, 44 may be electrically connected to respective end conductors, terminals or end caps (not shown). It should be appreciated that first and second end portions 42, 44 may also include one or more high resistance regions 34, such as illustrated in FIG. 3. Moreover, a conventional housing (not shown) may surround the fusible element 30.

It should be understood that the geometric configuration of fusible element 30 shown in FIGS. 1-2 is for illustrating an embodiment of the present invention, and not for limiting same. In this regard, it is contemplated that fusible element 30 may have alternative geometries.

In one example embodiment of the present invention, fusible element 30 has a width in the range of 0.4-0.7 inches, a length in the range of 2.5-2.9 inches, and a thickness of 0.006 - 0.007 inch. However, it should be appreciated that the dimensions of fusible element 30 may vary significantly from the foregoing dimensions depending upon the application, size of the fuse housing, required ampere rating of the fuse, and the like.

In the illustrated embodiment a first arc suppressor 60 is fixed to fusible element 30 at first end portion 42 and a second arc suppressor 60 is fixed to fusible element 30 at second end portion 44. Accordingly, first and second arc suppressors 60 are provided at opposite sides of high resistance regions 34 of intermediate portion 32 so as to contain any electric arc "burn back." However, it is contemplated that in alternative embodiments one or more arc suppressors 60 may be fixed anywhere axially on fusible element 30 including a location at, or proximate to, a high resistance region 34 of first and second end portions 42, 44 and intermediate portion 32.

As best seen in FIG. 3, each arc suppressor 60 includes first and second inner members 62, 64 comprised of silicone rubber, and first and second outer members 72, 74 comprised of melamine. In accordance with an embodiment of the present invention, first and second inner members 62, 64 take the form of a sheet or plate comprised of pre-cured (i.e., hardened) silicone rubber; and first and second outer members 72, 74 take the form of a sheet or plate comprised of pre-cured melamine. In the illustrated embodiment, first and second inner members 62, 64 and first and second outer members 72, 74 are generally planar and rectangular-shaped, with holes h formed therein that are dimensioned to receive a mechanical fastener 80.

One suitable material for first and second inner members 62, 64 is a high temperature silicone rubber sheet having a durometer of Shore "A" 70+/−5 (preferred but not limited to Shore "A" 70) and a temperature range of up to 500° F. The silicone rubber sheet is pre-fabricated into individual plates, wherein the dimensions of the plates are a function of the width of fusible element 30.

One suitable material for first and second outer members 72, 74 is a NEMA grade G9 glass-reinforced melamine plastic laminate sheet. Melamine is a preferred material since it provides rigidity, stability, as well as arc quenching abilities. It is also contemplated that other materials (preferably with arc quenching properties) may be substituted for melamine that provide a similar level of rigidity (e.g., a fiber sheet made of vulcanized fiber and other materials including thermosets, or extruded materials).

In the one example embodiment of the present invention, first and second inner members 62, 64 and first and second outer members 72,74 have a width in the range of 0.8-0.9 inch (preferably 0.84 inch), a length in the range of 0.65-0.75 inch (preferably 0.68 inch) and a thickness in the range of 0.025-0.035 inch (preferably 0.031 inch). However, it should be appreciated that the dimensions of the first and second inner members 62, 64 and first and second outer members 72, 74 may vary significantly from the foregoing dimensions depending upon the application, since the dimensions of the first and second inner members 62, 64 and first and second outer members 72,74 are selected to accommodate fusible elements 30 of varying dimensions.

When assembled, first inner member 62 is located adjacent to first surface 52 of fusible element 30 and second inner member 64 is located adjacent to second surface 54 of fusible element 30. Likewise, when assembled, first outer member 72 is located adjacent to first inner member 62 and second outer member 74 is located adjacent to second inner member 64.

While the illustrated embodiment of the present invention shows the first and second inner members 62, 64 and first and second outer members 72, 74 as planar and rectangular-shaped, it is contemplated that other geometric configurations may also be used.

Figure 4:
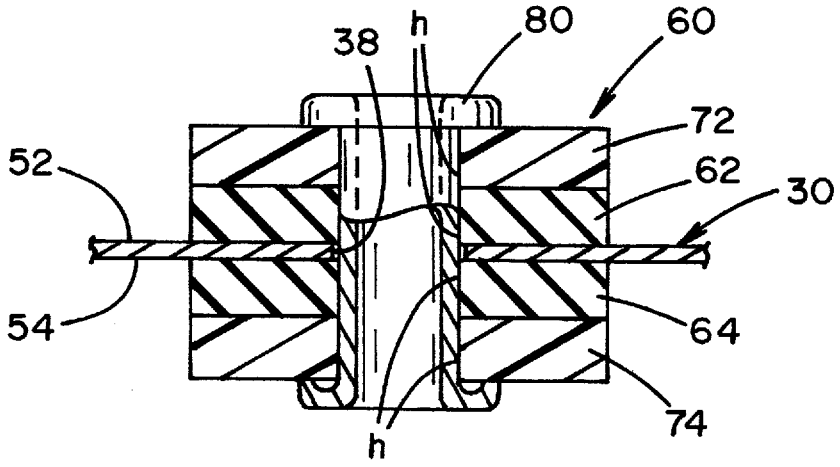
FIG. 4 is a cross-sectional portion of the arc suppressor according to the present invention, as attached to the fusible element.

One or more fasteners 80 fix inner members 62, 64 and outer members 72, 74 to fusible element 30. Fasteners 80 are used to "sandwich" a section of first end portion 42 and a section of end portion 44 between first and second inner members 62, 64, with first and second outer members 72, 74 respectively located adjacent to first and second inner members 62, 64, as best seen in FIGS. 2 and 4.

In one embodiment, fasteners 80 take the form of brass/bronze eyelets or rivets. However, alternative types of fasteners are also contemplated, such as staples.

In the illustrated embodiment, two fasteners 80 are used to fix inner members 62, 64 and outer members 72, 74 to fusible element 30. However, it is contemplated that additional fasteners 80 may be used depending upon the dimensions of the inner members 62, 64 and outer members 72, 74.

The process for assembling arc suppressors 60 according to the illustrated embodiment will now be described in detail. It is contemplated that a conventional riveter press be used to secure eyelets. The riveter press may include both adjustable plates and "hard" stops to accommodate various widths and thicknesses for fusible element 30. Locating pins are used for placement of the eyelets.

First, eyelets are placed onto locating pins and the first outer member 72 is placed over the eyelets by inserting the eyelets through holes h. Next, first inner member 62 is placed over the eyelets by inserting the eyelets through holes h, thereby locating first inner member 62 adjacent to first outer member 72. Fusible element 30 is then stacked onto the first inner member 62 by inserting the eyelets through holes 38, thereby locating fusible element 30 adjacent to first inner member 62.

Thereafter, second inner member 64 is placed over the eyelets by inserting the eyelets through holes h, thereby locating second inner member 64 adjacent to fusible element 30. Next, second outer member 74 is placed over the eyelets by inserting the eyelets through holes h, thereby locating second outer member 74 adjacent to second inner member 64.

The plate of the riveter press is adjusted to accommodate a fusible element 30 of a desired width, and the riveter press is cycled to form rivets that tightly engage together first and second inner members 62, 64, fusible element 30, and first and second outer members 72, 74, thereby forming a "sandwich" with minimal gaps between adjacent components (see FIG. 4). A typical cycle time for the riveter press is about 4 seconds.

The stacked inner and outer members 62, 72 and 64, 74 create a solid barrier on fusible element 30 that prevents electric arc "burn-back" from traveling beyond the pair of arc suppressors 60. This allows fusible element 30 to successfully clear a circuit in the event of an overcurrent (i.e., overload current or short circuit) or overload event.

It is contemplated that applications for arc suppressor 60 of the present invention include, but are not limited to, photovoltaic applications, traction fuses, Class J fuses, Class L fuses, and special purpose fuses.

It is further contemplated that holes 38 in fusible element 30 and holes h in first and second inner and outer members 62, 64 and 72, 74 may be omitted where fasteners 80 are attached by puncturing members 62, 64, 72, 74 and fusible element 30. For example, in an embodiment where fasteners 80 take the form of staples, the staples pierce first and second inner members 62, 64 and first and second outer members 72, 74.

It should be appreciated that the length dimension of first and second inner members 62, 64 and first and second outer members 72, 74 may be selected such that fasteners 80 are located at distal ends of members 62, 64, 72, and 74 "outside" fusible element 30. In this alternative embodiment, fasteners 80 do not extend through fusible element 30.

According to an alternative embodiment of the present invention, first and second outer members 72, 74 take the form of a laminate. In this regard, an arc quenching material comprising first and second outer members 72, 74 (e.g., melamine, vulcanized fiber, thermoset, or extruded material) is laminated onto first and second inner members 62, 64 before assembly of arc suppressors 60. In this embodiment first inner member 62 and first outer member 72 form a single unitary component and second inner member 64 and second outer member 74 form a single unitary component, thereby simplifying assembly of arc suppressors 60.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A fuse comprising:

a fusible element made of a conductive metal having opposing first and second surfaces, said fusible element including (i) an intermediate portion having at least one region of high resistance, and (ii) first and second end portions located at opposite sides of the intermediate portion; and at least one arc suppressor fixed to a selected one of the intermediate portion or the first or second end portions of the fusible element, to create a solid barrier on the portion of the fusible element that prevents electric arc "burn-back" from traveling along the fusible element beyond the selected portion including the at least one arc suppressor, each arc suppressor comprising:

first and second inner members comprised of pre-fabricated plates formed from a sheet of pre-cured silicone rubber;

first and second outer members comprised of an arc quenching material, wherein said first inner member is located adjacent to the first surface of the fusible element and the second inner member is located adjacent to the second surface of the fusible element, and said first outer member is located adjacent to the first inner member and the second outer member is located adjacent to the second inner member; and one or more fasteners for fixing the first and second inner members and the first and second outer members to the fusible element as a sandwich between the adjacent first and second inner members, fusible element, and first and second outer members.

2. A fuse according to claim 1, wherein at least one arc suppressor is fixed to the fusible element at the first end portion and at least one arc suppressor is fixed to the fusible element at the second end portion.

3. A fuse according to claim 1, wherein said at least one arc suppressor is fixed to the fusible element at the intermediate portion.

4. A fuse according to claim 1, wherein said at least one arc suppressor is fixed to the fusible element at a region of high resistance.

5. A fuse according to claim 4, wherein at least one of said first and second end portions includes a region of high resistance.

6. A fuse according to claim 1, wherein said arc quenching material is selected from the group consisting of: melamine, a vulcanized fiber, and an extruded material.

7. A fuse according to claim 1, wherein said one or more fasteners are rivets, eyelets or staples.

8. A fuse according to claim 1, wherein said first and second inner members and said first and second outer members include holes dimensioned to receive said fasteners.

9. A fuse according to claim 8, wherein said fusible element includes holes dimensioned to receive said fasteners.

10. A fuse according to claim 1, wherein said fasteners pierce said first and second inner members and said first and second outer members.

11. A fuse according to claim 10, wherein said fasteners pierce said fusible element.

12. A fuse according to claim 1, wherein said first and second inner members and said first and second outer members are generally planar and rectangular-shaped.

13. A fuse according to claim 1, wherein said first outer member and said second outer member are respectively laminated on said first inner member and said first outer member.

14. An arc suppressor fixable to a fusible element, the arc suppressor comprising:

first and second inner members comprised of pre-fabricated plates of pre-cured silicone rubber;

first and second outer members comprised of melamine, wherein said first inner member is located adjacent to a portion of a first surface of the fusible element and the second inner member is located adjacent to an opposing portion of a second surface of the fusible element, and said first outer member is located adjacent to the first inner member and the second outer member is located adjacent to the second inner member; and one or more fasteners for fixing the first and second inner members and first and second outer members to the fusible element to form a laminate with minimal gaps between the adjacent first and second inner members and the first and second outer members along the portion of the fusible element.

15. A fuse according to claim 14, wherein said one or more fasteners are rivets, eyelets or staples.

16. A fuse according to claim 14, wherein said first and second inner members and said first and second outer members include holes dimensioned to receive said fasteners.

17. A fuse according to claim 14, wherein said fusible element includes holes dimensioned to receive said fasteners.

18. A fuse according to claim 14, wherein said fasteners pierce said first and second inner members and said first and second outer members.

19. A fuse according to claim 14, wherein said first and second inner members and said first and second outer members are generally planar and rectangular-shaped.

20. A fuse according to claim 14, wherein said first outer member and said second outer member are respectively laminated on said first inner member and said second inner member.

21. A process for producing a fuse, comprising:

placing a first inner member comprised of a pre-fabricated plate formed out of a sheet of pre-cured silicone over a first outer member formed out of a sheet of pre-cured melamine, thereby locating the first inner member adjacent to the first outer member;

stacking a fusible element onto the first inner member, thereby locating the fusible element adjacent to the first inner member;

placing a second inner member comprised of a pre-fabricated plate formed out of a sheet of pre-cured [melamine] silicone over the fusible element, thereby locating the second inner member adjacent to the fusible element;

placing a second outer member formed out of a sheet of pre-cured [silicone] melamine over the second inner member, thereby locating the second outer member adjacent to the second inner member; and pressing the first and second inner members, fusible element, and first and second outer members with a fastener to engage together to form a fuse with an arc suppressor as a sandwich with minimal gaps between the adjacent first and second inner members, fusible element, and first and second outer members.

* * * * *